US005987643A

United States Patent [19]

Beutler

[11] Patent Number: 5,987,643

[45] Date of Patent: Nov. 23, 1999

[54] PROTECTIVE KNEE PAD AND METHOD OF CONSTRUCTION THEREOF

[76] Inventor: Park Beutler, 1431 E. Voughton, Ogden, Utah 84403

[21] Appl. No.: 08/729,624

[22] Filed: Oct. 11, 1996

[51] Int. Cl.[6] ..... A41D 13/00

[52] U.S. Cl. ..... 2/24; 2/455

[58] Field of Search ..... 2/24, 22, 455, 2/267, 456

[56] References Cited

U.S. PATENT DOCUMENTS

| | | | |
|---|---|---|---|
| 3,551,912 | 1/1971 | Viglione | 2/24 |
| 4,120,052 | 10/1978 | Butler | 2/24 |
| 4,198,708 | 4/1980 | Fugere et al. | 2/24 |
| 4,296,744 | 10/1981 | Palumbo | 2/24 |
| 4,354,280 | 10/1982 | Hayes | 2/24 |
| 4,484,361 | 11/1984 | Leighton et al. | 2/24 |
| 4,561,123 | 12/1985 | Hull | 2/24 |
| 4,599,747 | 7/1986 | Robinson | 2/24 |
| 5,416,924 | 5/1995 | Sims | 2/24 |
| 5,477,558 | 12/1995 | Volker et al. | 2/24 |

*Primary Examiner*—Gloria M. Hale
*Attorney, Agent, or Firm*—Trask, Britt & Rossa

[57] ABSTRACT

A knee pad includes an irregularly shaped flat single piece material that is folded to form an articulated (bent) pad to provide protection for a user's knee. The pad includes side walls to protect the side of the knees. The side walls may also help prevent rotation of the knee pad about the user's knee. The pad is covered with a cover to which an attaching structure is attached. The knee pad is attached to the user's leg through the attaching structure. The attaching structure may include a flexible sleeve and an optional zipper. Straps provide additional tension and help prevent rotational or upward or downward movement of the knee pad with respect to the user's knee. An optional additional pad may be attached to the articulated pad. A hard shell or cap may be placed on the front of the cover. The shell will withstand impacts that may tear the cover, which may be nylon. The shell is preferably removable. An elbow pad or wrist pad may be used under the same principles. A pad according to the invention may be used, for example, by persons participating in sports, such as skating and cycling.

11 Claims, 10 Drawing Sheets

PROTECTIVE KNEE PAD AND METHOD OF CONSTRUCTION THEREOF

BACKGROUND OF THE INVENTION

1. Field of the Invention

The invention relates to a protective knee pad or elbow pad with sidewalls and a method of constructing the same. The knee pad may have particular use for persons participating in sports activities, such as with roller skates, in-line skates, skateboards, and bicycles.

2. State of the Art

People have long enjoyed roller skating and riding on skateboards. More recently, in-line skates have become popular. While many persons skate at a relatively safe pace, others seek high speed and perform tricks or other maneuvers that push the envelope of performance and safety.

BMX (bicycle motorcross) cyclists also seek to push the envelope of performance and consequently occasionally fall off their bikes or intentionally lay down the bikes.

Unfortunately, many persons have been injured skating and cycling. Even those persons who try to skate conservatively and safely occasionally fall and are injured. The injuries range from bruises to broken bones to more serious injuries. Various pads have been designed to protect skaters, including knee pads, elbow pads, and wrist pads.

In addition to protecting skaters from unintentional falls, knee pads are often used by high performance skaters in intentional falls. For example, if a skater feels like he is beginning to lose control, he may intentionally fall on his knees and slide in a stable position until his speed is reduced. Accordingly, such knee pads should have a high degree of durability and strength.

Currently available knee pads provide protection to the front of the knee, but not as much protection to the side of the knee. Further, a knee pad may rotate about a person's leg leaving a portion of the knee unprotected during a fall. Elbow pads or wrist pads also do not provide full protection to the side and may rotate, leaving a portion of the elbow unprotected during a fall.

Accordingly, there is a need for protective knee pads, elbow pads, and wrist pads that provide protection to the side of the knee, elbow, and wrist. There also is a need for such pads that are resistant to rotation.

SUMMARY OF THE INVENTION

The present invention relates to a knee pad including sidewalls. The knee pad preferably includes an articulated pad or other inner pad of which the sidewalls are an integral part. Alternatively, the sidewalls may be provided by a separate pad or pads. In a preferred embodiment, the articulated pad is formed of an irregularly shaped single piece material. The irregularly shaped single piece material is preferably flat prior to folding.

The knee pad preferably includes a cover that encloses or otherwise fully or partially covers the articulated pad. Alternatively, the articulated pad or other pads may be uncovered.

In a preferred embodiment, an attaching structure, to attach the knee pad to the knee, is connected to the cover. The attaching structure may be of a different material than the cover or part of the cover. The attaching structure may include a flexible sleeve and an optional zipper. Straps provide additional tension and help prevent rotational or upward or downward movement of the knee pad with respect to the user's knee. The attaching structure may be connected directly to the articulated pad or other pad. An optional additional pad may be attached to the articulated pad or other inner pad. A hard shell or cap may be placed on the front of the cover. The shell will withstand impacts that may tear the cover, which may be nylon. The shell is preferably removable.

The invention may be used in connection with an elbow knee pad or a wrist pad. A wrist pad may include a stiff structure to restrain movement in certain directions.

Preferably, the side walls help prevent rotational movement of the knee pad.

A pad according to the invention may be used, for example, by persons participating in sports, such as skating and cycling.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF PREFERRED EMBODIMENTS

Figure 1:
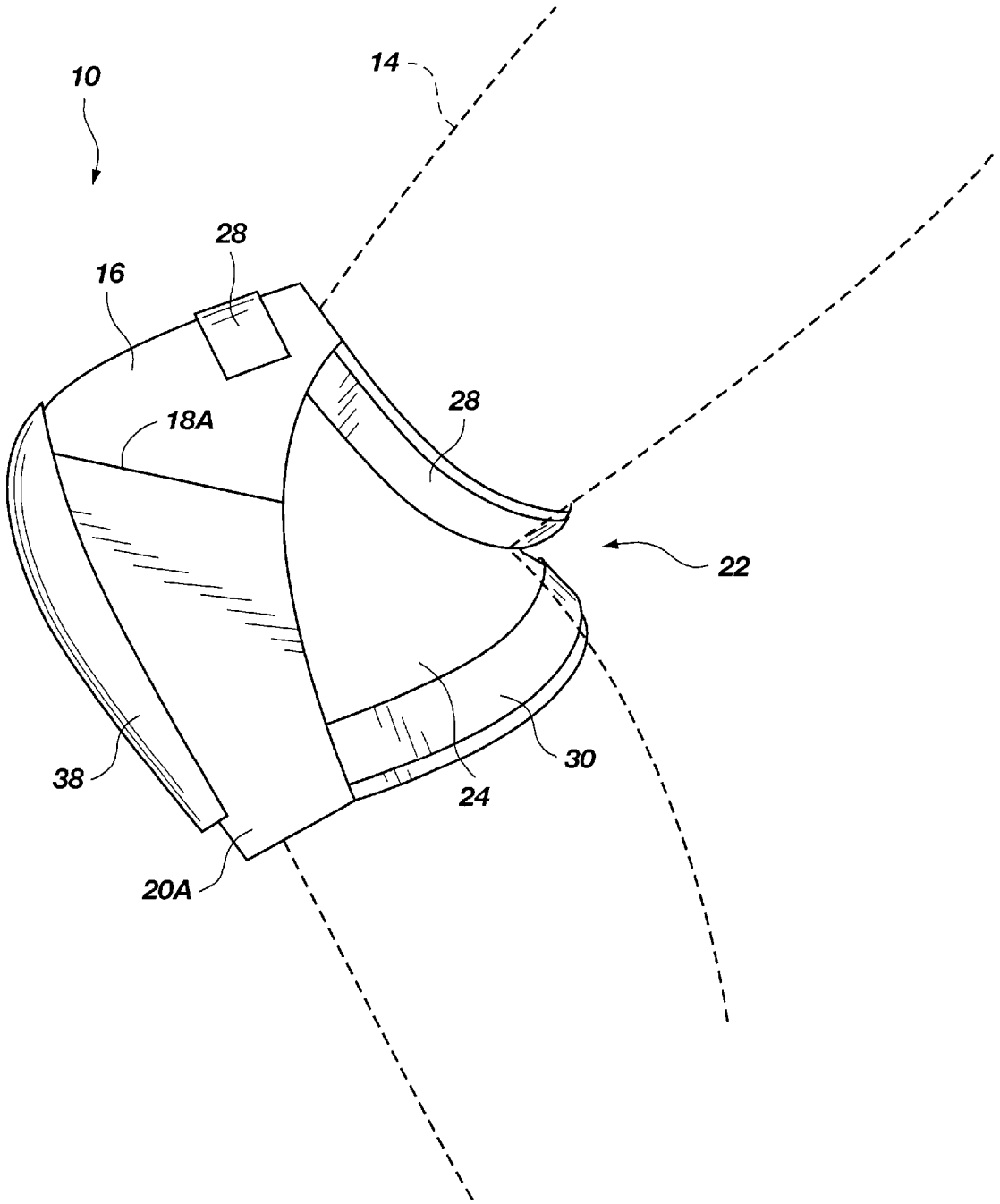
FIG. 1 is a side view of a knee pad in accordance with one embodiment of the present invention.

Referring to FIG. 1, a protective knee pad 10 is shown as it may be worn on a leg 14, shown in dashed lines. Knee pad 10 includes an outer cover 16 that covers one or more inner pads, discussed below. Cover 16 may include a seam 18A for ease of construction. A section 20A of cover 16 is used as a reference for comparison with other figures. Knee pad 10 may be attached to leg 14 through a variety of attachment structures. For example, in FIG. 1, an attaching structure 22 includes a rear sleeve or band 24 connected to cover 16. Leg 14 slips through sleeve 24, which preferably has some elasticity. Sleeve 24 may be made of neoprene or other suitable material. To further secure knee pad 10 to leg 14, an upper strap 28 and a lower strap 30 are adjustably tightened around leg 14.

A hard outer shell or cap 38 may be attached to cover 16 through VELCRO™. Shell 38 is strong enough to withstand impacts that may tear cover 16. It is preferred that outer shell 38 be replaceable. Outer shell 38 may be made of various materials including an extruded grade polyethylene or a nylon grade material.

Figure 2:
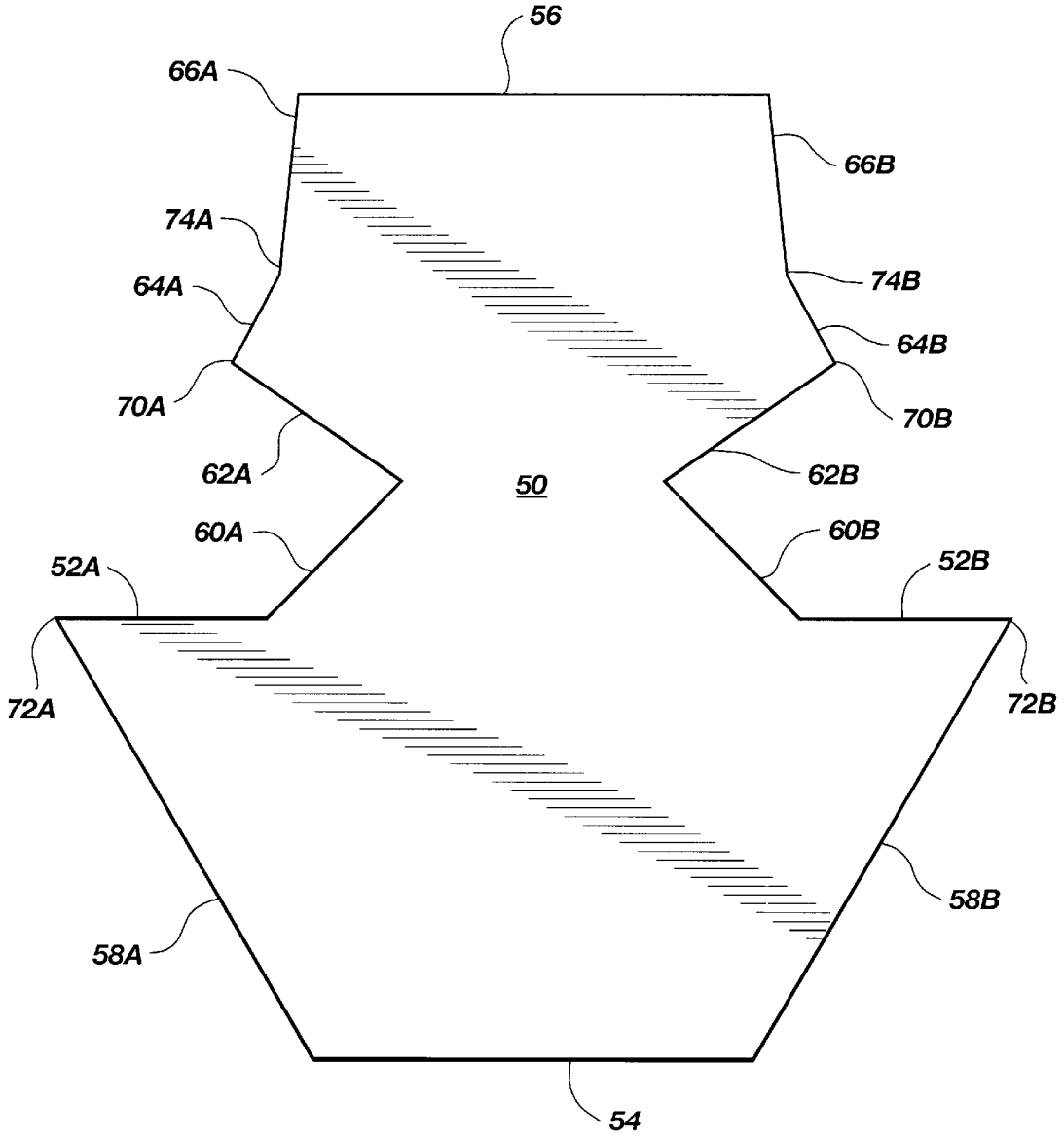
FIG. 2 is a plan view of a piece of padding material used to make the knee pad in accordance with one embodiment of the present invention.

Referring to FIG. 2, an inner pad 46 (shown in FIGS. 3A–3C) is made of a flat, single piece of material 50. Material 50 may be stamped from a larger piece of material or originally formed in the shape shown in FIG. 2. Material 50 includes side edges 52A, 52B, 54, 56, 58A, 58B, 60A, 60B, 62A, 62B, 64A, 64B, 66A, and 66B and points 70A, 70B, 72A, and 72B. Points 74A, 74B exist at the intersection of side edges 64A, 66A and 64B, 66B respectively (FIGS. 2 & 3C). Material 50 may be any of various materials, including a close-cell EVA foam. In a preferred embodiment, material 50 is one inch thick and is a two-pound material. Of course, other thicknesses and densities could be used.

Figure 3A:
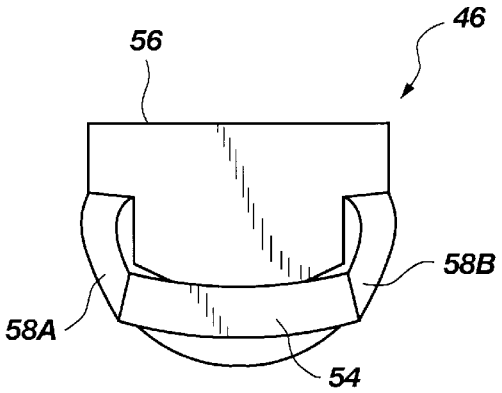
FIG. 3A is bottom view of the piece of padding illustrated in FIG. 2 formed in accordance with one embodiment of the present invention.
Figure 3B:
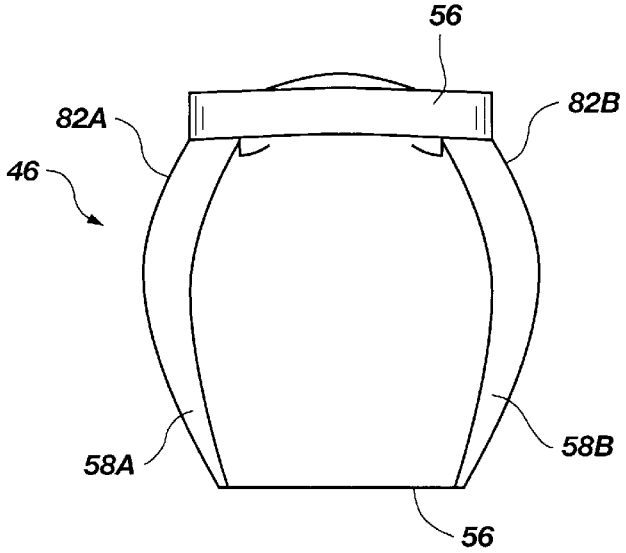
FIG. 3B is a back view of the piece of padding illustrated in FIG. 2 formed in accordance with one embodiment of the present invention.
Figure 3C:
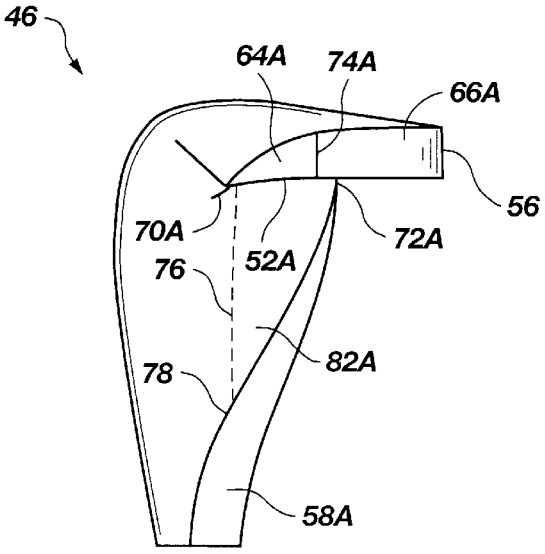
FIG. 3C is a side view of the piece of padding illustrated in FIG. 2 formed in accordance with one embodiment of the present invention.

Referring to FIGS. 3A–3C, material 50 is configured to form an articulated inner pad 46. The construction of inner pad 46 is illustrated by comparing reference numbers between FIG. 2 and FIGS. 3A–3C. Where an edge is joined to another edge or a surface, it may be through glue, such as a strong contact cement. The edges and surfaces may be joined all at once. Alternatively, edges 60A and 62A and edges 60B and 62B may be joined before the other edges and surfaces.

Inner pad 46 is articulated or bent so as to fit the knee when the knee is bent, which the knee is likely to be at the time of an intentional or unintentional fall. Of course, inner pad 46 could be formed from multiple pieces of material (as opposed to a single piece as shown in FIG. 2).

Inner pad 46 includes side walls 82A and 82B. Side wall 82A is shown in FIG. 3C. Referring to FIG. 3C, dashed line 76 extends from approximately point 70A to approximately a point 78. (Dashed line 76 is provided only for reference and is not part of knee pad 10.) Side wall 82A includes that area of material 50 between dashed line 76, edge 58A, and edge 52A. However, the shapes of material 50 and pad 46 may be chosen to be somewhat different than that shown in FIGS. 2 and 3A–3C. Accordingly, the area of the side wall may be somewhat different depending on the shapes chosen. Indeed, the precise dimensions of the side wall are not important, but rather that there is some section that will protect the side of the knee. In a preferred embodiment, the side wall covers half the knee so that bones on the side of the knee are covered and protected. Sidewall 82A tapers downward where less coverage is needed. Tapering increases the flexibility of knee pad 10.

The sidewalls may help prevent rotation of knee pad 10.

Figure 5:
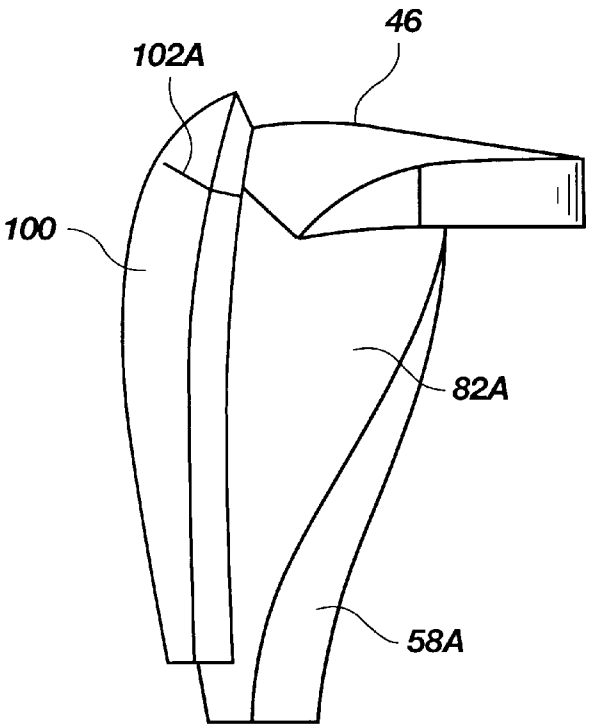
FIG. 5 is a side view of the piece of padding illustrated in FIG. 4 formed and attached to the padding illustrated in FIGS. 3A–3C.
Figure 4:
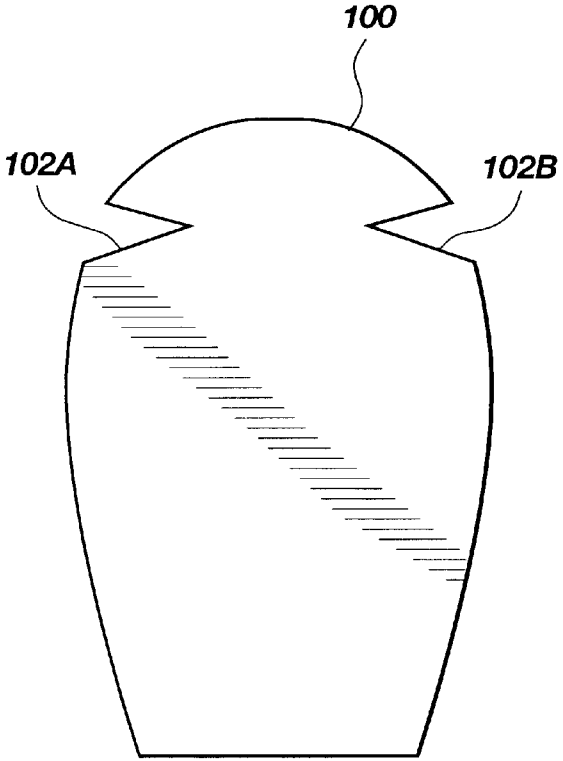
FIG. 4 is a plan view of an optional additional piece of padding material used to provide additional padding to the padding illustrated in FIGS. 3A–3C.

Referring to FIGS. 4 and 5, an optional additional inner pad 100 may be attached to the front of inner pad 46. Inner pad 100 may be formed of a single piece of material with slits 102A and 102B which are joined through, for example, glue to form a rounded shape to fit over a section of inner pad 100. Inner pad 100 may be glued to inner pad 46. Inner pad 100 may be made of a one-half inch, four pound, close-cell EVA foam, or any of various other suitable materials.

Figure 6:
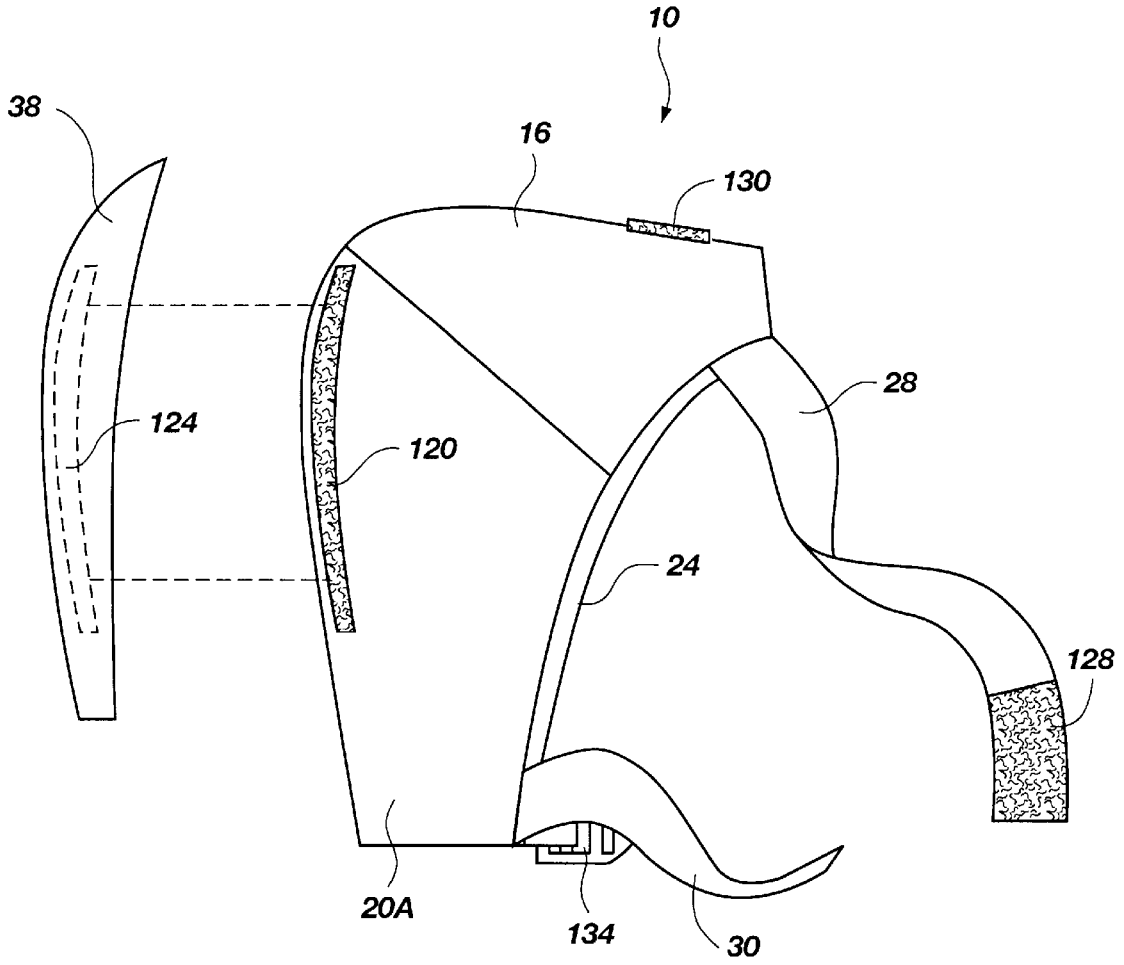
FIG. 6 is an exploded side view of the knee pad of FIG. 1.
Figure 7:
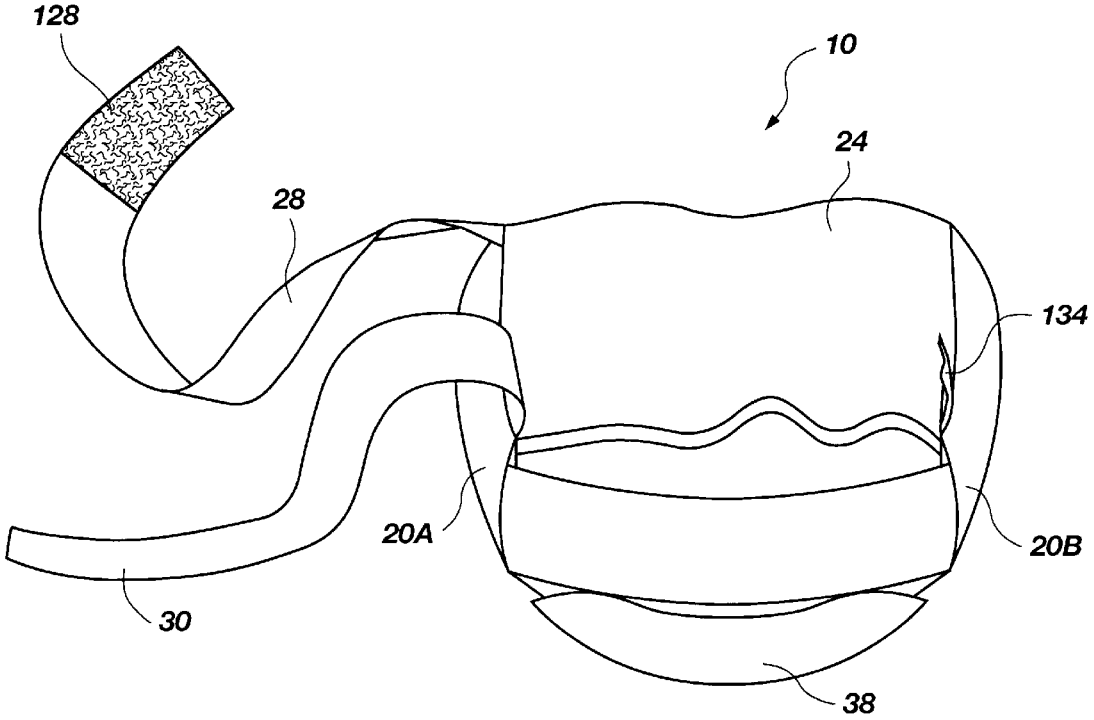
FIG. 7 is a bottom view of the knee pad of FIG. 1.

Referring to FIGS. 1, 6, and 7, inner pad 46 alone (as shown in FIGS. 3A–3C), or the combined inner pad 46 and inner pad 100 (as shown in FIG. 5), may be placed in a cover 16. Although it is not required, there may be different sizes of cover 16: one for inner pad 46 alone, and one for the combined inner pad 46 and inner pad 100. There may also be different sizes for different size people. For example, a large man would have a different knee pad size than would a child. Cover 16 may be made of nylon or any other suitable fabric. That portion of cover 16 that is next to the user's knee (inside sleeve 24) may be made of a stretchable fabric (e.g. a thin neoprene).

Referring to FIG. 6, shell 38 may be held on by VELCRO™ interacting strips. One of the strips (strip 120) is illustrate in FIG. 6. A matching VELCRO™ interacting attachment member section 124 is connected to the inside of shell 38. Alternatively, shell 38 may be removably attached through some other means or permanently attached to cover 16. A wide variety of straps and joiners for connecting the straps may be used. For example, upper strap 28 may be a two-inch wide elastic material with a VELCRO™ interacting attachment member section 128 that connects with a matching VELCRO™ interacting attachment member section 130. (Preferably, VELCRO™ interacting attachment member sections 120 and 124 require a much greater force to separate than do VELCRO™ interacting attachment member sections 128 and 130.) Lower strap 30 may be made of one and one-half inch wide nylon webbing that connects to a one and one-half inch tension lock buckle 134.

Figure 8:
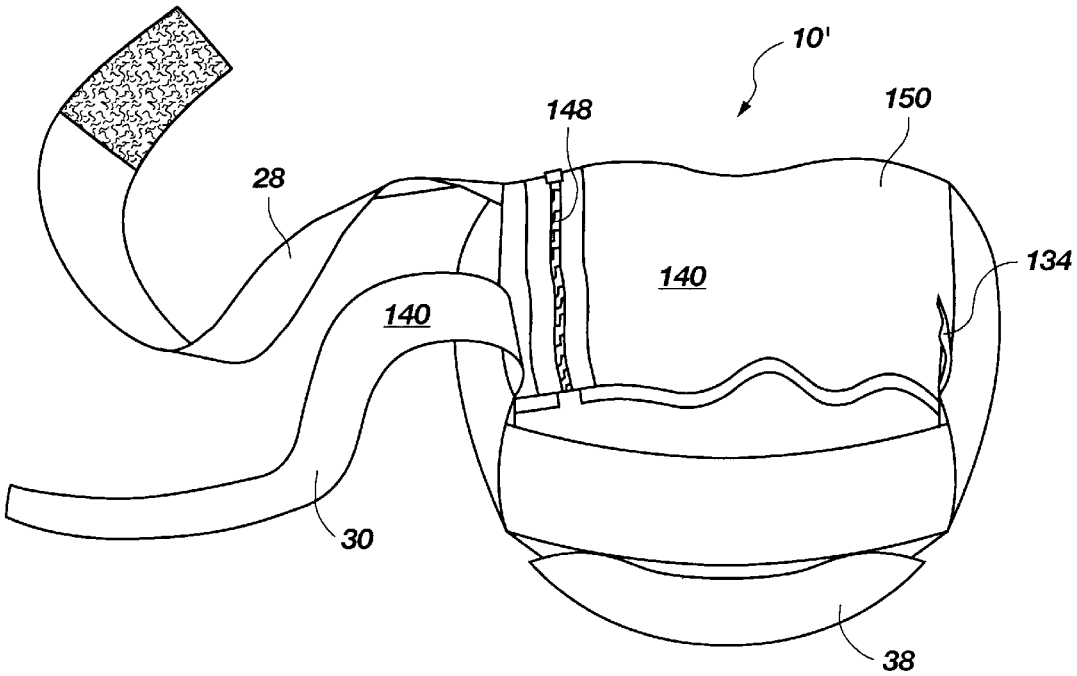
FIG. 8 is a top view of knee pad in accordance with a second embodiment of the present invention.
Figure 12:
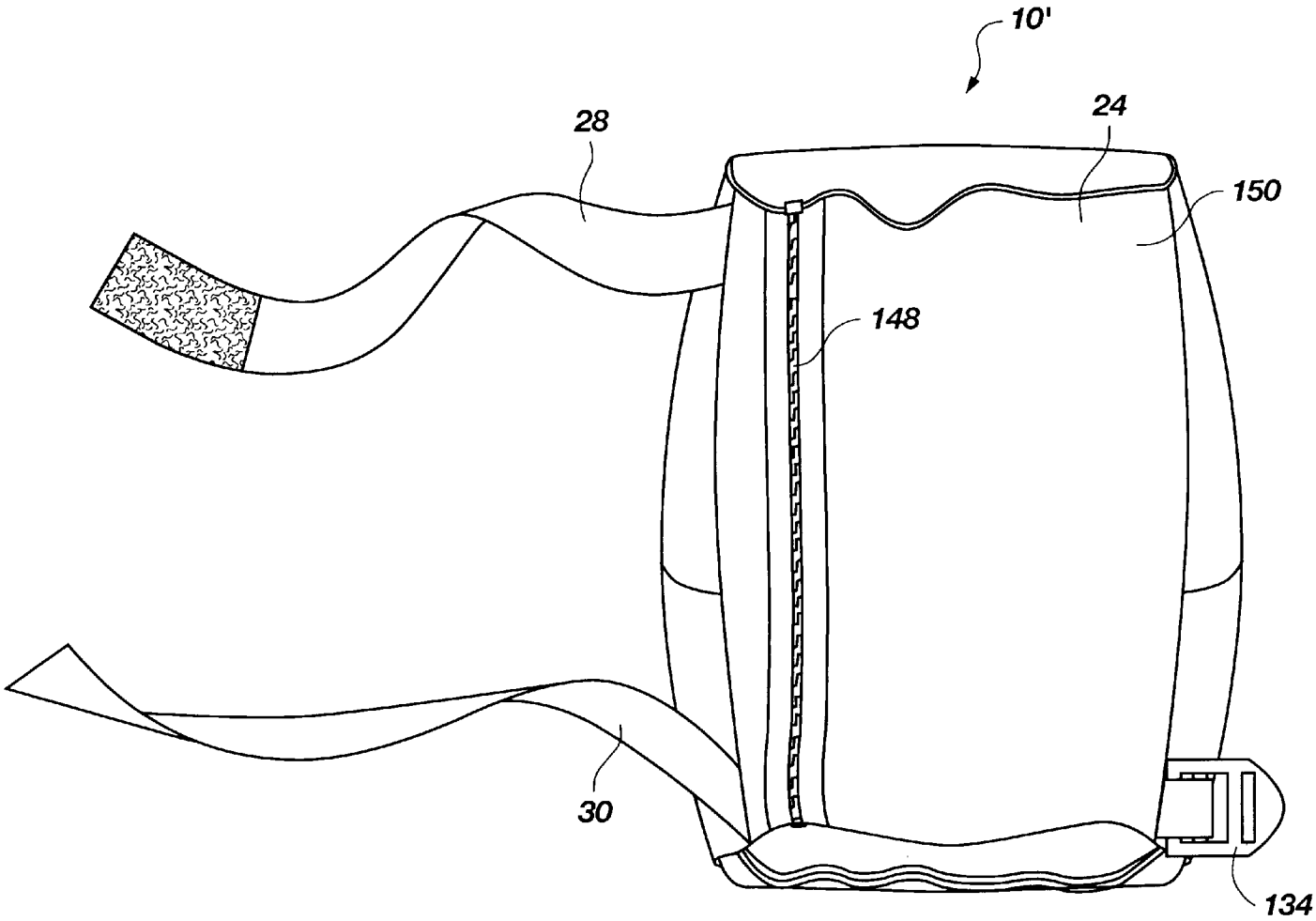
FIG. 12 is a back view of the knee pad illustrated in FIG. 8.

FIGS. 8 and 12 illustrate an alternative means of attaching cover 16 of a knee pad 10' to the user's leg. An attaching structure 140 may be the same as attaching structure 22, except that attaching structure 140 includes a zipper 148 in a sleeve or band 150, similar to sleeve 24. Knee pad 10' may be otherwise the same as, or differ somewhat from, knee pad 10.

Figure 9:
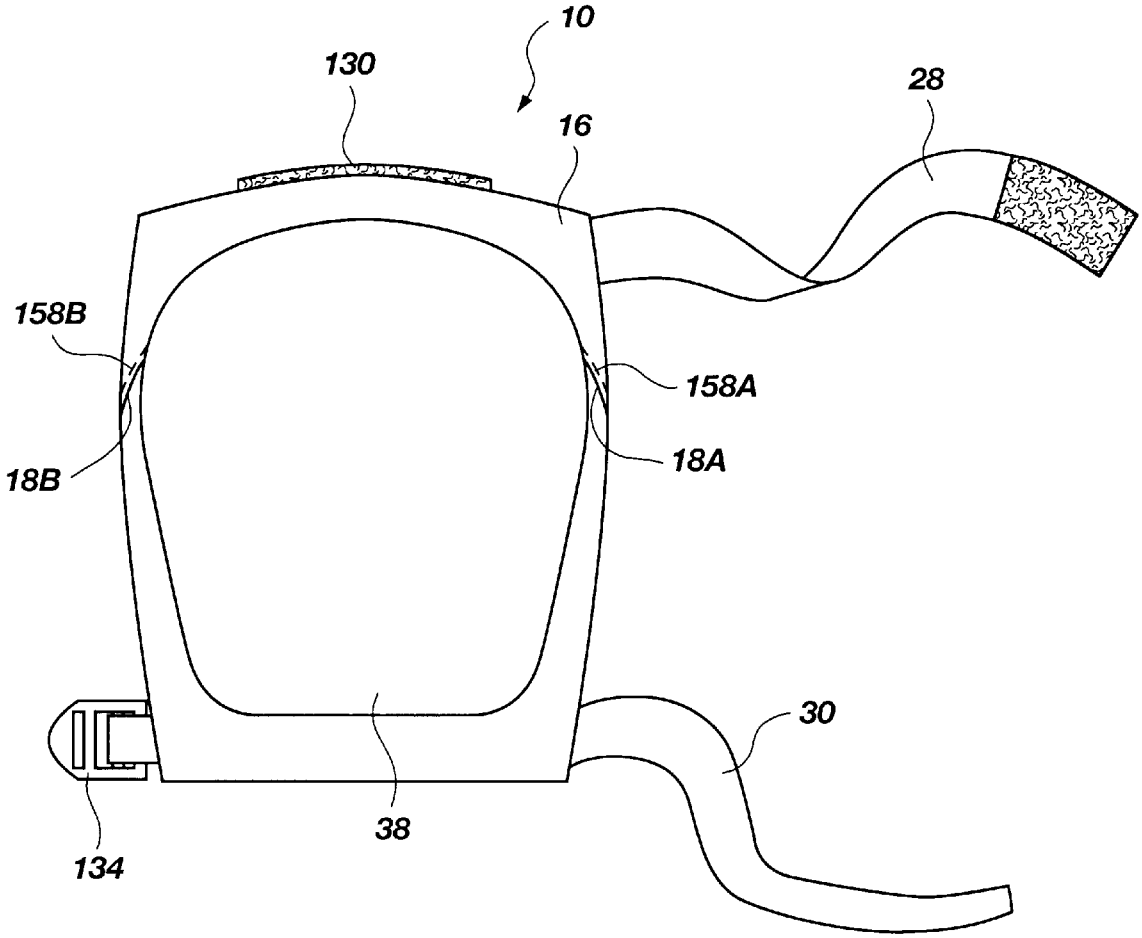
FIG. 9 is a front view of the knee pad of FIG. 1.
Figure 10:
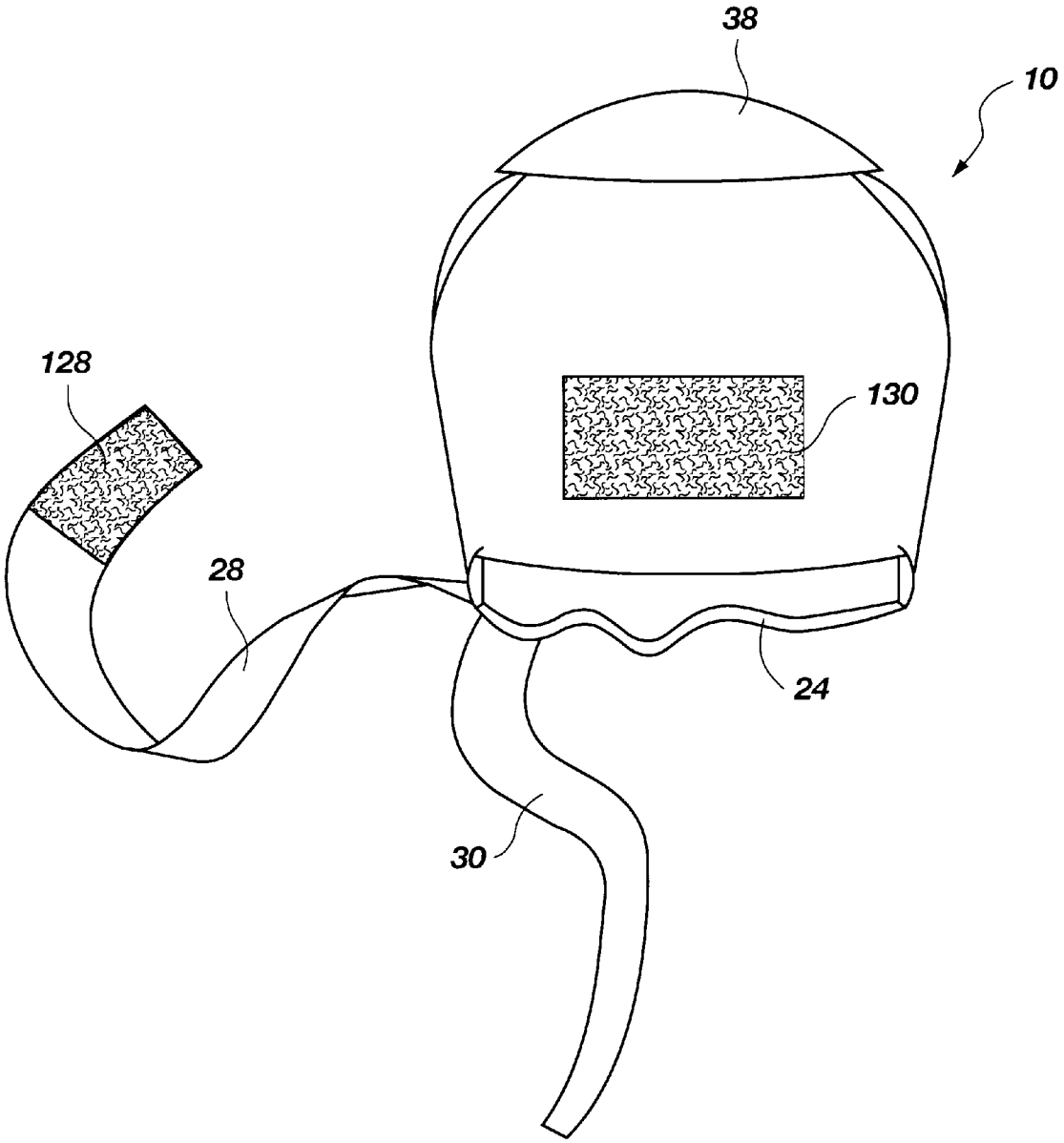
FIG. 10 is a top view of the knee pad of FIG. 1.
Figure 11:
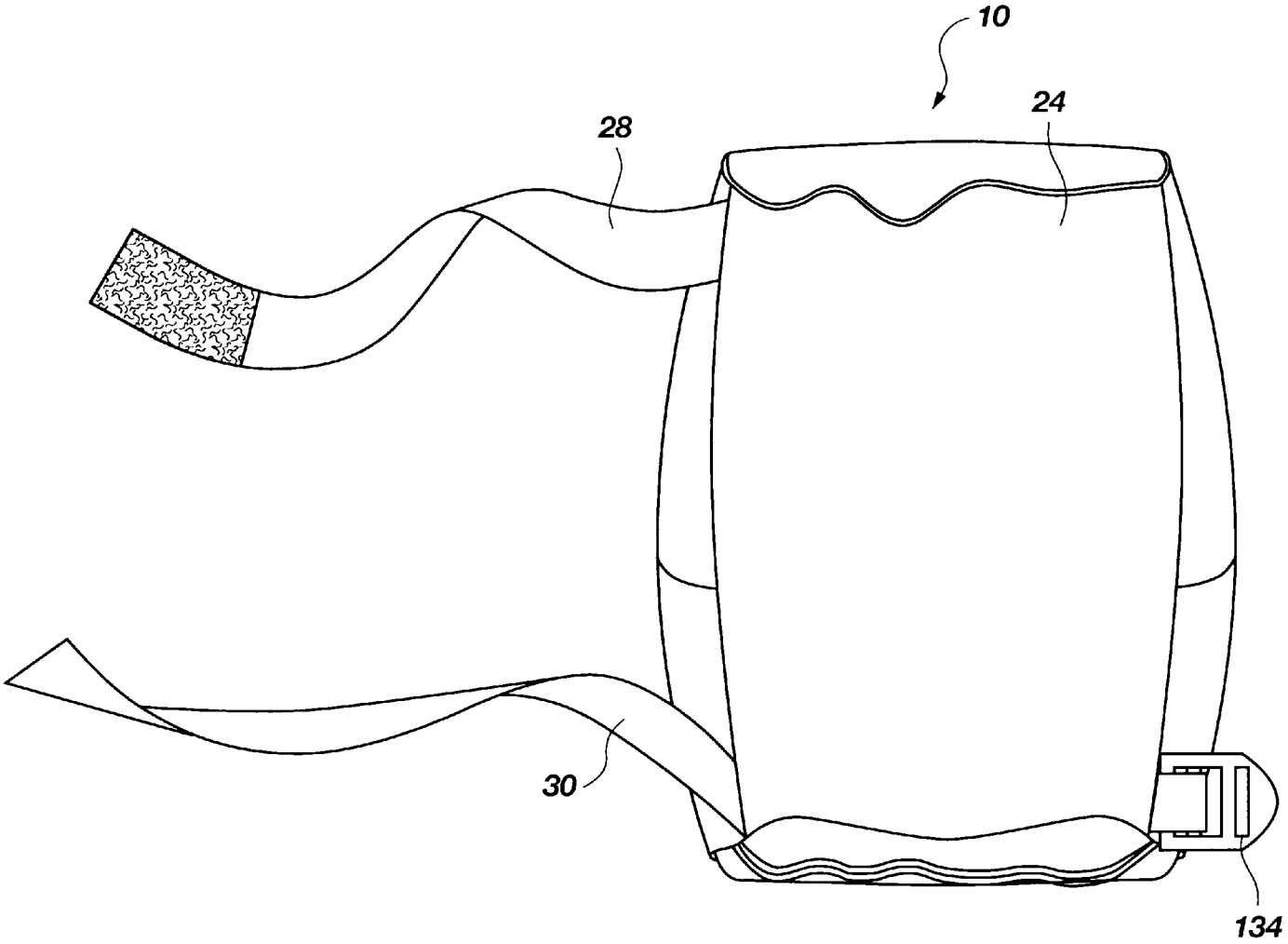
FIG. 11 is a back view of the knee pad of FIG. 1.

FIGS. 9, 10, and 11 show additional views of knee pad 10. Referring to FIG. 9, stitching 158A and 158B may be used to form seams 18A and 18B in cover 16.

The appearances of knee pads 10 and 10' are ornamental and pleasing.

As used in the claims, the term "connect," "connectable," or "connected to" are not necessarily limited to a direct connection.

Having thus described in detail preferred embodiments of the present invention, it is to be understood that the invention defined by the appended claims is not to be limited by particular details set forth in the above description as many apparent variations thereof are possible without departing from the spirit or scope thereof.

What is claimed is:

1. A knee pad, comprising:

an articulated pad including side walls and edges, at least a portion of said edges being folded and joined to one another at a joint edge area to form the articulated pad;

a cover that completely encloses the articulated pad; and an attaching structure connected to the cover, the attaching structure being suitable for attaching the knee pad to a user's leg.

2. The knee pad of claim 1 wherein the attaching structure includes a sleeve and straps.

3. The knee pad of claim 1, wherein the articulated pad includes side walls.

4. The knee pad of claim 1, wherein the articulated pad is formed of a single piece of material.

5. A knee pad, comprising:

in articulated pad including side walls and edges, said articulated pad formed of an irregularly shaped, single piece of material, at least a portion of the edges being folded and joined to one another at a joint edge area to form the articulated pad;

a cover that encloses the articulated pad; and an attaching structure connected to the cover, the attaching structure being suitable for attaching the knee pad to a user's leg.

6. A protective pad, comprising:

an articulated pad including side walls and edges, at least a portion of said edges being folded and joined to one another at a joint edge area to form the articulated pad, said articulated pad formed of an irregularly shaped, single piece of first close-cell foam material having a first density, the irregularly shaped single piece material being flat prior to folding;

a cover that encloses the articulated pad; and an attaching structure connected to the cover, the attaching structure being suitable for attaching the protective pad to a user's body portion.

7. The protective pad of claim 6, further including an additional pad sandwiched between the articulated pad and the cover, said additional pad formed of a second close-cell foam material having a density less than said first density.

8. The protective pad of claim 6 wherein the first close cell foam material is two pound EVA foam about an inch thick.

9. The protective pad of claim 7 wherein the first close-cell foam material is two pound EVA foam about an inch thick.

10. The protective pad of claim 7 wherein the second close-cell foam material is four pound EVA foam about one-half inch thick.

11. The protective pad of claim 9 wherein the second close-cell foam material is four pound EVA foam about one-half inch thick.

* * * * *